US010527313B2

(12) United States Patent
Wolgamott et al.

(10) Patent No.: US 10,527,313 B2
(45) Date of Patent: Jan. 7, 2020

(54) BUILDING AIRFLOW MEASURING SYSTEM AND METHOD

(71) Applicants: Nikolas James Wolgamott, Grand Ledge, MI (US); Robert J. Pierce, III, Eaton Rapids, MI (US)

(72) Inventors: Nikolas James Wolgamott, Grand Ledge, MI (US); Robert J. Pierce, III, Eaton Rapids, MI (US)

(73) Assignee: NJK Precision LLC, Eaton Rapids, MI (US)

( * ) Notice: Subject to any disclaimer, the term of this patent is extended or adjusted under 35 U.S.C. 154(b) by 455 days.

(21) Appl. No.: 15/250,406

(22) Filed: Aug. 29, 2016

(65) Prior Publication Data

US 2017/0045389 A1 Feb. 16, 2017

Related U.S. Application Data

(63) Continuation-in-part of application No. 14/081,220, filed on Nov. 15, 2013, now abandoned.

(60) Provisional application No. 61/726,618, filed on Nov. 15, 2012.

(51) Int. Cl.

| | |
|---|---|
| ***F24F 13/02*** | (2006.01) |
| ***F24F 11/30*** | (2018.01) |
| ***F24F 11/89*** | (2018.01) |
| *F24F 110/00* | (2018.01) |
| *F24F 110/30* | (2018.01) |
| *F24F 11/63* | (2018.01) |

(52) U.S. Cl.

CPC ..... *F24F 13/02* (2013.01); *F24F 11/30* (2018.01); *F24F 11/89* (2018.01); *F24F 11/63* (2018.01); *F24F 2110/00* (2018.01); *F24F 2110/30* (2018.01)

(58) Field of Classification Search

CPC .. F24F 13/02; F24F 11/89; F24F 11/30; F24F 11/63; F24F 2110/30; F24F 2110/00

USPC ..... 454/229

See application file for complete search history.

(56) References Cited

U.S. PATENT DOCUMENTS

| | | | | |
|---|---|---|---|---|
| 4,164,144 | A * | 8/1979 | Kaiser | G01F 1/34 73/861.64 |
| 4,366,704 | A | 1/1983 | Sato et al. | |
| 5,048,327 | A | 9/1991 | Atwood | |
| 5,179,858 | A | 1/1993 | Atwood | |
| 5,383,356 | A | 1/1995 | Zurek et al. | |
| 5,481,925 | A | 1/1996 | Woodbury | |
| 5,581,026 | A | 12/1996 | Sawada et al. | |
| 6,018,994 | A | 2/2000 | Yonezawa et al. | |
| 6,101,869 | A | 8/2000 | Kadohiro et al. | |
| 6,467,359 | B1 | 10/2002 | Atwood | |
| 6,701,781 | B1 | 3/2004 | Lutowsky, Jr. et al. | |
| 6,715,367 | B1 | 4/2004 | Gonzales et al. | |

(Continued)

*Primary Examiner* — Gregory L Huson
*Assistant Examiner* — Dana K Tighe
(74) *Attorney, Agent, or Firm* — Fay Sharpe LLP

(57) ABSTRACT

A mass airflow measuring device includes an air passageway and a body positioned in the passageway. The body includes a peripheral section including a first channel, a sample section located radially inward of the peripheral section, and including an inlet port and a support section connecting the sample section to the peripheral section. The support section includes a second channel which communicates at a first end with the inlet port and at a second end with the first channel. A mass airflow sensor is mounted to the body.

13 Claims, 16 Drawing Sheets

(56) References Cited

U.S. PATENT DOCUMENTS

| | | | | |
|---|---|---|---|---|
| 6,865,957 | B1 | 3/2005 | Hughes et al. | |
| 6,928,884 | B1 * | 8/2005 | Pearson | G01F 1/46 73/861.42 |
| 7,280,927 | B1 | 10/2007 | Dmytriw | |
| 7,484,425 | B2 | 2/2009 | Hughes et al. | |
| 8,286,506 | B2 | 10/2012 | Speldrich | |
| 2004/0204871 | A1 | 10/2004 | Frie et al. | |
| 2007/0021049 | A1 * | 1/2007 | Bender | G01F 1/6842 454/141 |
| 2008/0053196 | A1 | 3/2008 | Fraden | |
| 2013/0055799 | A1 | 3/2013 | Tsujii | |
| 2016/0116320 | A1 | 4/2016 | Wolgamott et al. | |

* cited by examiner

BUILDING AIRFLOW MEASURING SYSTEM AND METHOD

CROSS REFERENCE TO RELATED APPLICATION

This application is a continuation-in-part of U.S. patent application Ser. No. 14/081,220 which was filed on Nov. 15, 2013 and is still pending. That application claims the priority of U.S. Provisional Application Ser. No. 61/726,618 filed Nov. 15, 2012. Both of these applications are incorporated herein by reference in their entireties.

BACKGROUND

The present disclosure is directed to airflow measuring systems and methods, and in particular to a system and method for measuring airflow in a building.

Controlling airflow, both in regard to volume and temperature, within a building is important to the comfort and well being of the building's occupants. Heating and cooling a building necessarily involves significant energy costs. Present techniques for monitoring and/or controlling airflow within a building utilize airflow measuring structures with limitations on accuracy, which thereby can impact the comfort of the building occupants as well as the heating and cooling costs. It would be desirable to provide a mass airflow measuring device or structure that interferes as little as possible with the flow of air in an air duct. It would also be desirable to provide a mass airflow measuring system that can accurately measure airflow at low flow rates.

BRIEF SUMMARY

The present disclosure provides an accurate mass airflow measuring device, system and method for measuring airflow in a building.

According to one aspect of the present disclosure, a mass airflow measuring device comprises a main air passageway through which air is allowed to flow, a first channel with apertures operatively leading from the main air passageway to the first channel to allow air flowing through the main air passageway to enter the first channel. Also included is a second channel that is located downstream relative to the first channel, and a sample channel leading from the first channel to the second channel to allow airflow from the first channel to flow toward the second channel. A mass airflow sensor is positioned within the sample channel to receive airflow and is operative to output an airflow signal based on the airflow received by the mass airflow sensor. A processing unit receives the airflow signal from the mass airflow sensor and processes the signal to output a processed airflow signal.

In particular embodiments, the airflow signal output by the mass airflow sensor comprises a non-linear signal relative to airflow received by the mass airflow sensor, with the processed airflow signal output by the processing unit comprising a linear signal relative to the airflow received by the mass airflow sensor. The processing unit may convert the non-linear airflow signal from the mass airflow sensor to a linear processed airflow signal based on stored correlated values or computational processing, such as by floating point mathematics. The processing unit may also buffer air flow signal readings from the mass airflow sensor and determine an average airflow signal, such as based on time, with the processed airflow signal being determined from the average airflow signal.

According to a further aspect of the present disclosure, the mass airflow sensor comprises building mass airflow sensor. The mass airflow sensor may include, for example, a housing and a selectively heated wire, with the housing having an inlet aperture and an exit aperture where airflow enters the housing through the inlet aperture, passes over the wire, and exits through the exit aperture. The mass airflow sensor also detects the temperature of the airflow and outputs a temperature signal, with the processing unit receiving and processing the temperature signal to output a processed temperature signal.

In one aspect of the present disclosure, a mass airflow measuring device is incorporated with an HVAC system by joining the device with a variable air volume (VAV) box, with the processing unit of the device providing processed airflow and temperature signals to a controller, such as a direct digital control system of the HVAC system. In another aspect of the present invention a mass airflow measuring device is integrated with an air balancing hood and a display to enable a user to measure air flowing out of an air terminal.

Methods of measuring airflow utilizing a mass air flow measuring device may be employed for controlling airflow within a building. Utilizing the accurate airflow and temperature signals supplied to an HVAC system provides operational real time precision measurement of air volume, thus enabling controlled temperature adjusted airflow to various zones within a building while maintaining required ventilation and providing significant energy savings.

According to another embodiment of the present disclosure, a mass airflow measuring device comprises an air passageway and a body positioned in the passageway. The body comprises a peripheral section including a first channel, a sample section located radially inward of the peripheral section and including an inlet port and a support section connecting the sample section to the peripheral section. The support section includes a second channel which communicates at a first end with the inlet port and at a second end with the first channel. A mass airflow sensor is disposed in the body.

In accordance with a further aspect of the present disclosure, a mass airflow measuring device comprises an air passageway defined in a duct and an integral body positioned in the air passageway. The body comprises a ring-shaped peripheral section including a first channel, a sample section located radially inwardly of the peripheral section and including an inlet port and a support section connecting the sample section to the peripheral section. The support section includes a second channel which communicates at a first end with the inlet port and at a second end with the first channel. A mass airflow sensor communicates with one of the first and second channels.

In accordance with a yet further aspect of the present disclosure, a mass air flow measuring device comprises an air passageway defined in a duct and a body positioned in the air passageway, the body comprising a leading side and a trailing side which are secured to each other. The body comprises a ring-shaped peripheral section adapted to be mounted to the duct, with the peripheral section including a first channel and a sample section located radially inwardly of the peripheral section and including an inlet port and a support section connecting the sample section to the peripheral section. The support section includes a second channel which communicates at a first end with the inlet port and at a second end with the first channel. A mass airflow sensor is mounted to one of the support section and the peripheral section and communicates with the second channel.

These and other features of this disclosure will become apparent upon review of the following specification in conjunction with the drawings.

BRIEF DESCRIPTION OF THE DRAWINGS

The present disclosure may take physical form in certain parts and arrangements of parts, several embodiments of which will be described in detail in this specification and illustrated in the accompanying drawings which form a part hereof and wherein.

DESCRIPTION OF THE PREFERRED EMBODIMENTS

Figure 1:
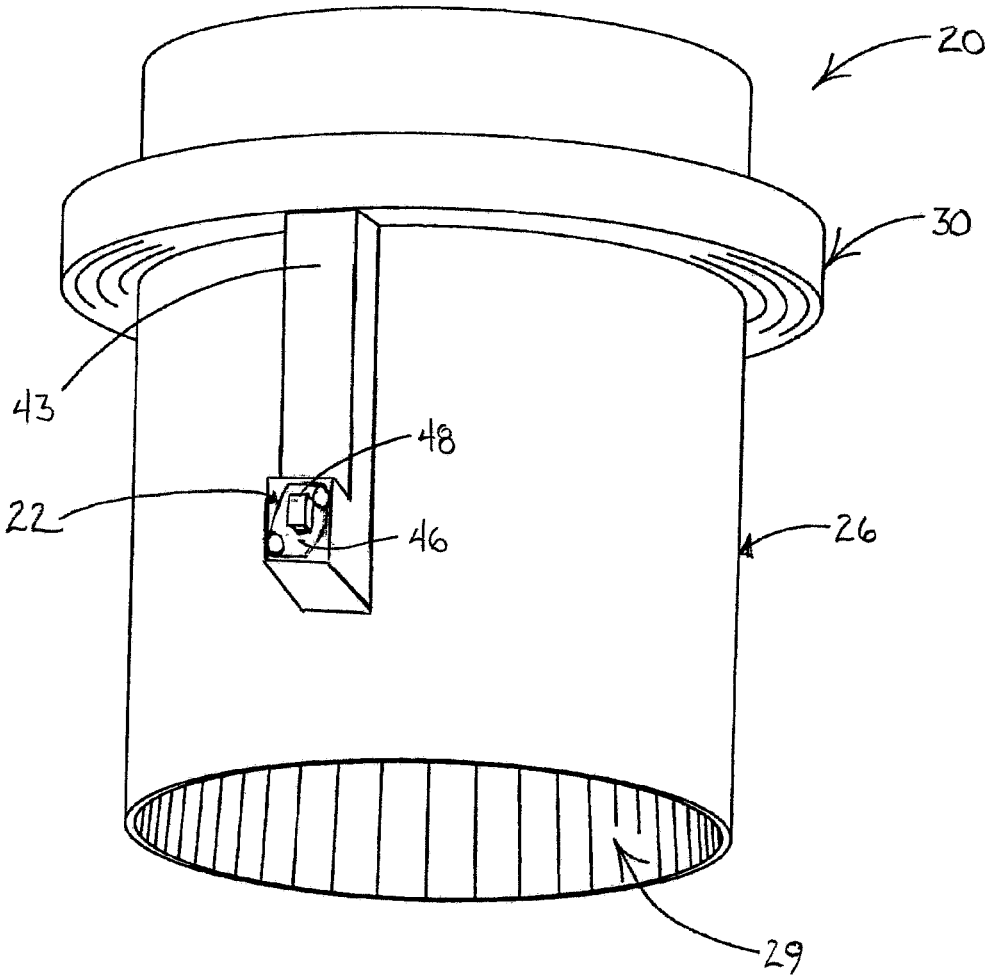
FIG. 1 is a perspective view of a mass airflow measuring device in accordance with one embodiment of the present disclosure.

The present invention will now be described with reference to the accompanying figures, wherein the numbered elements in the following written description correspond to like-numbered elements in the figures. FIG. 1 discloses a mass airflow measuring device 20 for measuring airflow related to a building, such as through the heating, ventilating and/or air-conditioning (HVAC) system of a building, where device 20 may be temporarily or permanently installed within a path of flowing air in the building.

Figure 4:
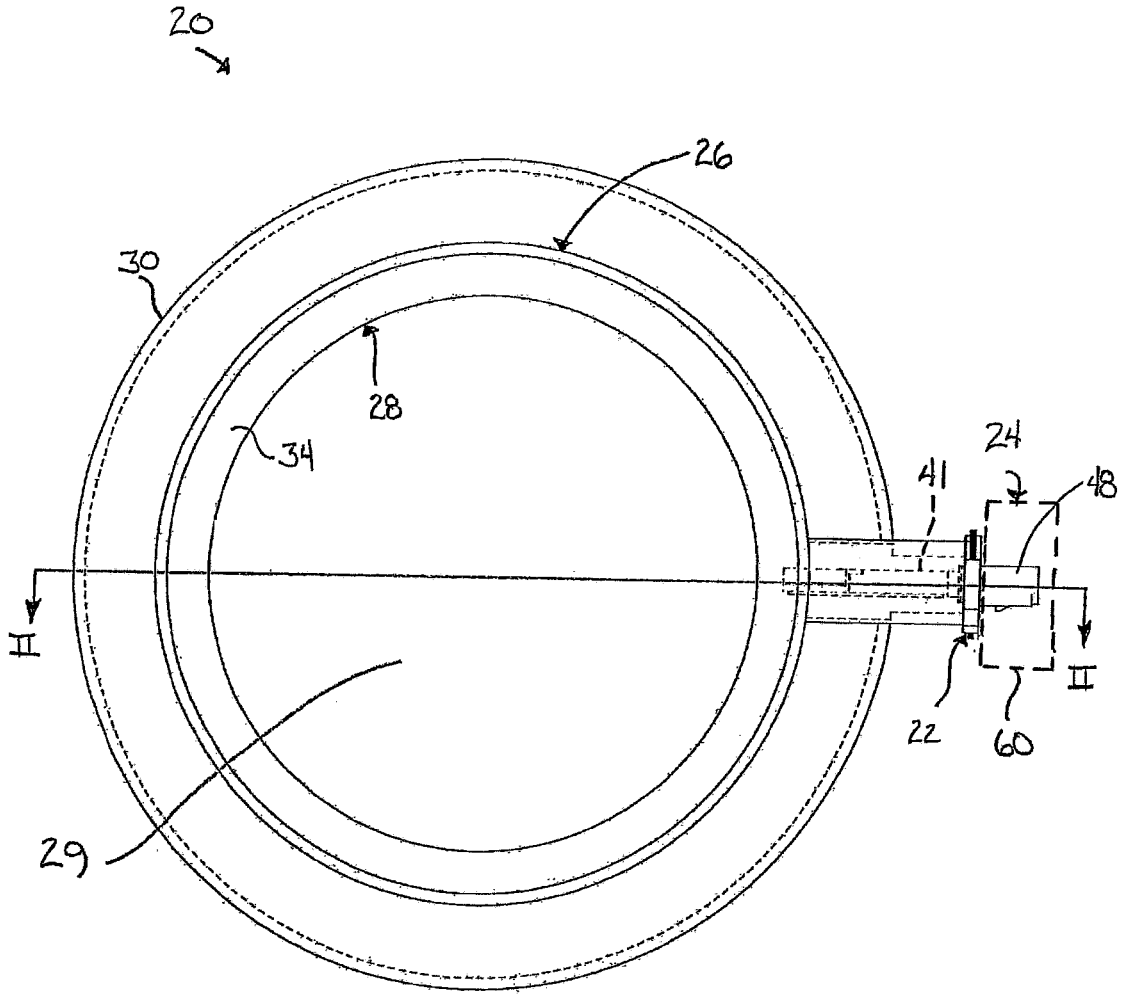
FIG. 4 is a bottom end view of the mass airflow measuring device of FIG. 1 from the airflow exit direction.
Figure 5:
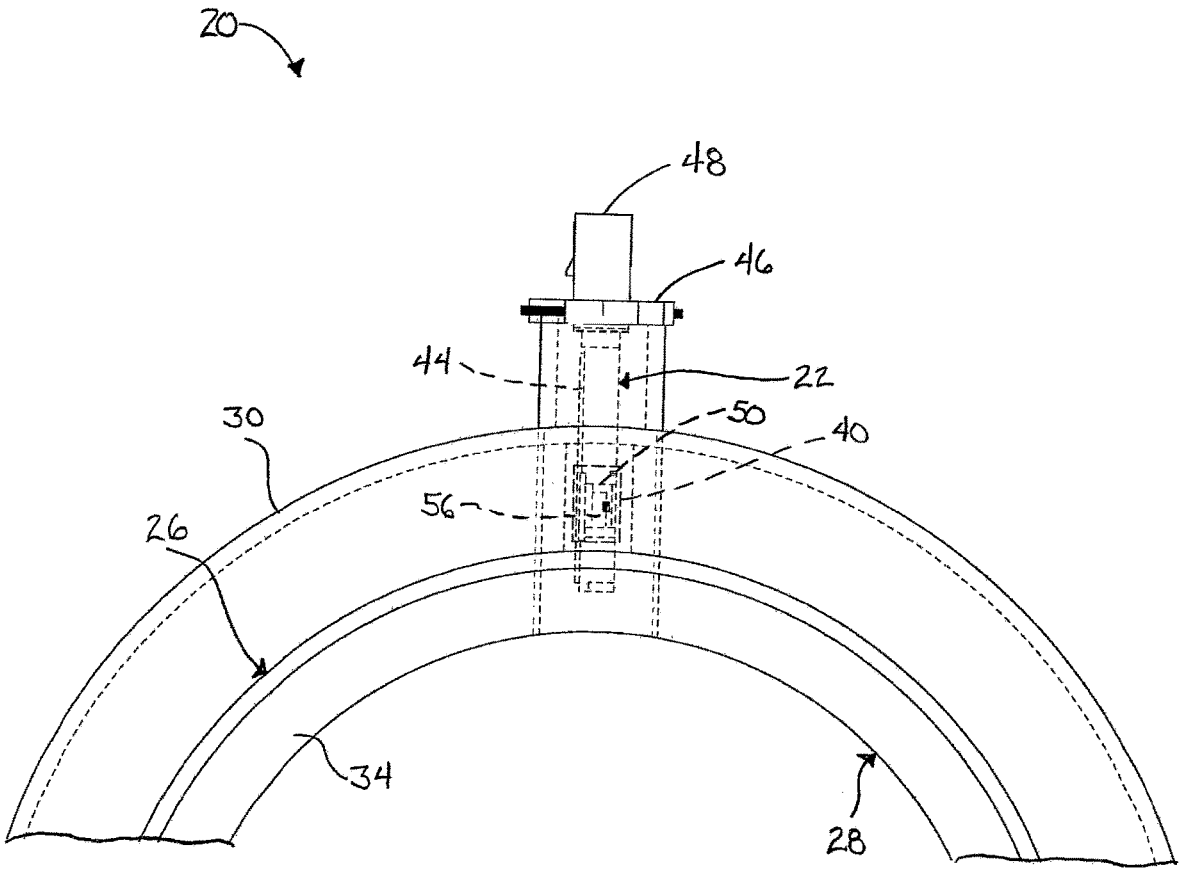
FIG. 5 is a partial top end view of the mass airflow measuring device of FIG. 1 from the airflow entry direction.

Device 20 includes an airflow sensor 22 comprising a hot wire anemometer measuring device that senses airflow and converts the sensed airflow to a voltage signal. Device 20 further includes a processor or processing unit 24 (FIGS. 2, 4 and 6B) operatively connected with sensor 22, where processor 24 receives the voltage signal from airflow sensor 22. In the illustrated embodiment, the signal supplied by sensor 22 is a non-linear voltage signal and, depending on the flow of air associated with the HVAC system through device 20, may have a high degree of fluctuation from turbulence. Based on the input signal from airflow sensor 22, processor 24 outputs a linear voltage, where the output signal from processor 24 may also be derived based on a time averaged sampling of the voltage signal from airflow sensor 22. The linear voltage output signal from processor 24 may then be provided to a direct digital control ("DDC") system associated with the building HVAC system for monitoring and optimizing the performance of the building's HVAC system.

Figure 2:
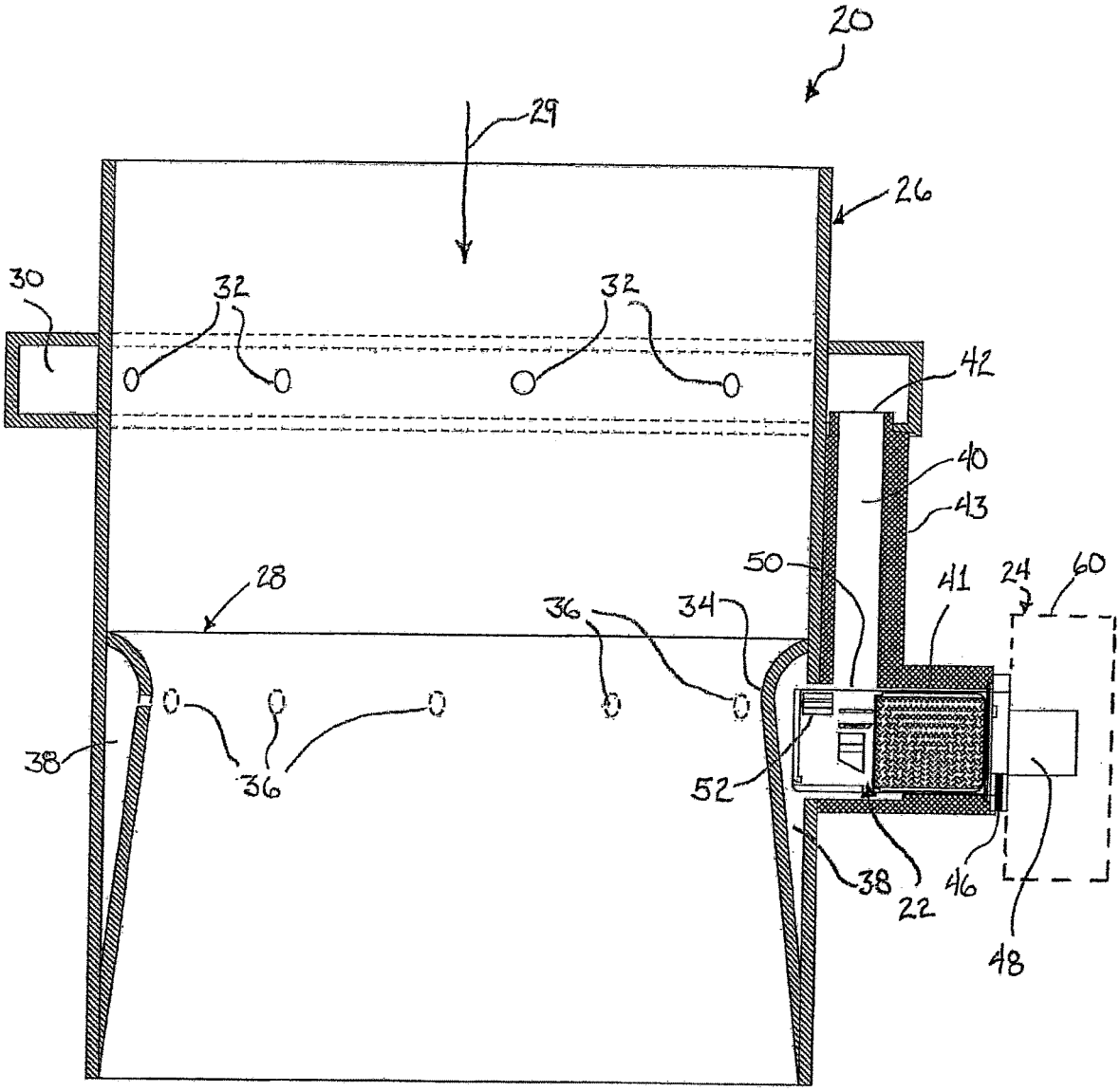
FIG. 2 is a cross-sectional side view of the mass airflow measuring device of FIG. 1 taken along the line II-II of FIG. 4.
Figure 3:
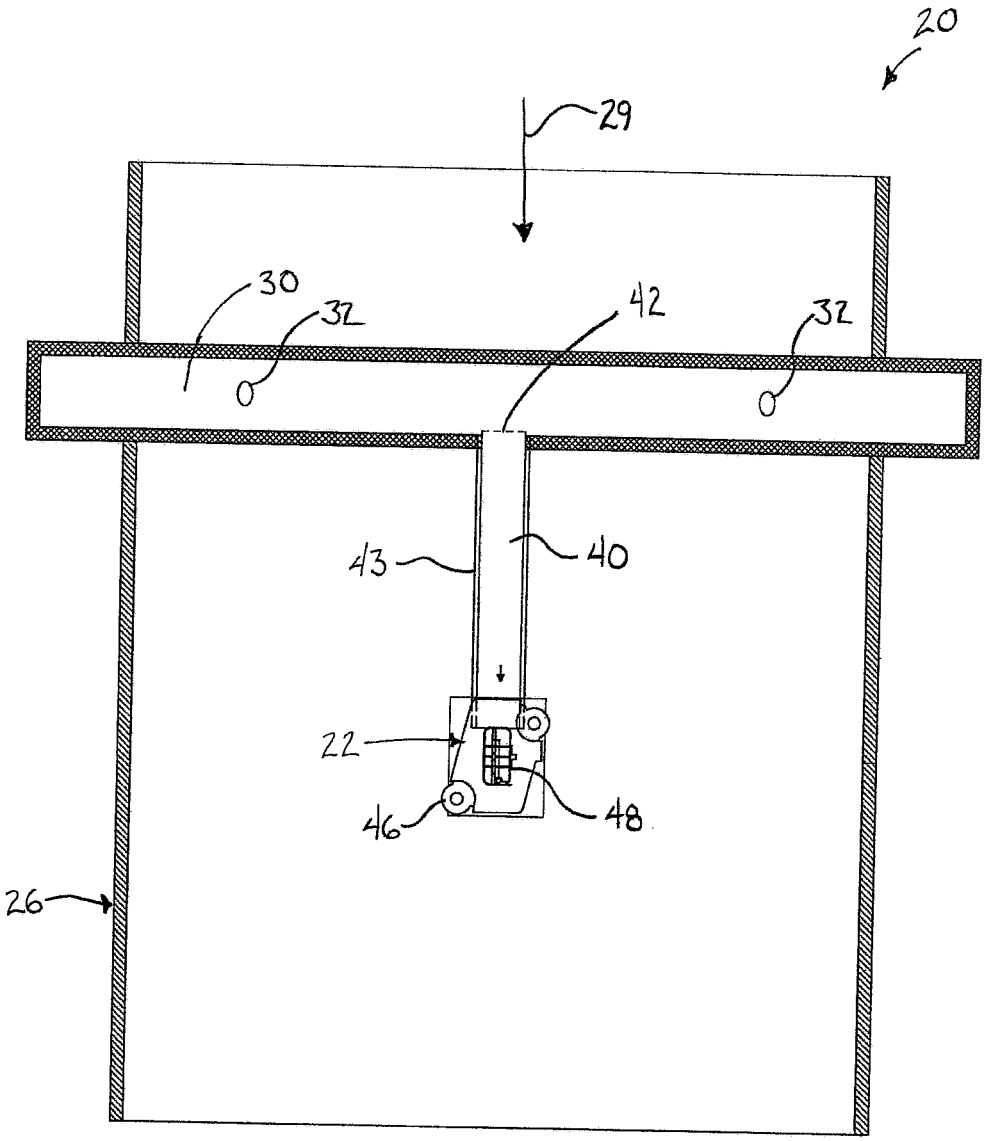
FIG. 3 is a partial radial cross-sectional side view of the mass airflow measuring device of FIG. 1 taken radially through the exterior annular channel.

With reference to FIGS. 1 to 5, device 20 includes both a main body 26 and a venturi member 28 (FIGS. 2 and 4), with venturi member 28 being received within the cylindrical interior of body 26 such that device 20 includes a central or main air passageway 29 through which air flows in the direction illustrated in FIGS. 2 and 3. A first channel comprising an annular static pressure manifold 30 is disposed around the exterior surface of main body 26 with first channel orifices or apertures 32 being located on main body 26 to allow airflow into manifold 30. Venturi member 28 includes a convergent air foil 34 and second channel orifices or apertures 36 at the venturi throat, with venturi member 28 forming a second channel comprising an annular cavity 38 relative to main body 26. A sample tube or channel 40 extends from manifold 30 to cavity 38, with channel 40 decreasing in size from inlet 42 to sensor 22 to increase the air velocity. After passing through sensor 22, as discussed below, channel 40 is increased to its original size whereby the air is given time to stabilize before being passed into annular cavity 38 where it is then re-introduced into the main airflow path by way of apertures 36, which are located at the smallest cross sectional area of venturi member 28. The airflow sensed by sensor 22 will be proportional to airflow in the main body 26. As thus described, main body 26 and venturi member 28 may be of generally similar construction to that disclosed in U.S. Pat. No. 6,467,359, which is hereby incorporated by reference.

As understood from FIG. 3, apertures 32 are located away from inlet 42—that is, an aperture 32 is not positioned directly above inlet 42. The spacing of apertures 32 from inlet 42 thereby promotes in providing a more laminar flow of air within channel 40. In addition, in the illustrated embodiment the first channel apertures 32 and second channel apertures 36 are shown as generally circular apertures. It should be appreciated, however, that numerous alternative arrangements for body 26 and venturi member 28 may be employed within the scope of the present invention. For example, rather than forming the first annular channel and sample channel on the exterior of main body 26 as in the embodiment of FIGS. 1-3, an alternative main body and internal venturi arrangement may be constructed in which the first annular channel and sample channel are located internally of the main body. Examples of such alternative arrangements are disclosed in U.S. Pat. No. 6,715,367, which is hereby incorporated by reference. As also shown and understood from U.S. Pat. No. 6,715,367, the sample channel delivering airflow from a first annular channel to sensor 22 may be angled, threaded or generally non-axially aligned relative to the longitudinal axis of the mass airflow measuring device. Accordingly, it should be appreciated that various particular features of U.S. Pat. Nos. 6,467,359 and 6,715,367 may be incorporated into the main body and venturi member of the mass airflow measuring device of the present invention. Moreover, the mass airflow measuring device may be constructed to have various sizes and shapes, such as of various cylindrical diameters or rectangular configurations.

Accordingly, a portion of the air flowing through device 20 will be drawn into manifold 30 and through sample channel 40 to sensor 22. In the illustrated embodiment sensor 22 comprises a conventional automotive mass airflow sensor used for vehicles, in which application sensor 22 is installed directly into the flow of air being supplied to a vehicle engine rather than a diverted air stream in accordance with the present invention. As is conventional with such mass air flow sensors, sensor 22 directly reads the mass of the airflow. An exemplary mass airflow sensor 22 may be supplied by Hitachi Automotive Systems America, Inc., such as, but not limited to, mass airflow sensors manufactured for the Ford Motor Company for the model years of 2005-2009. It should be appreciated, however, that numerous suppliers and types of such sensors are available due to the various makes and models of vehicles employing such sensors and that the present mass airflow measuring device may be utilized with a broad array of such sensors operating in accordance as set forth herein.

Figure 6A:
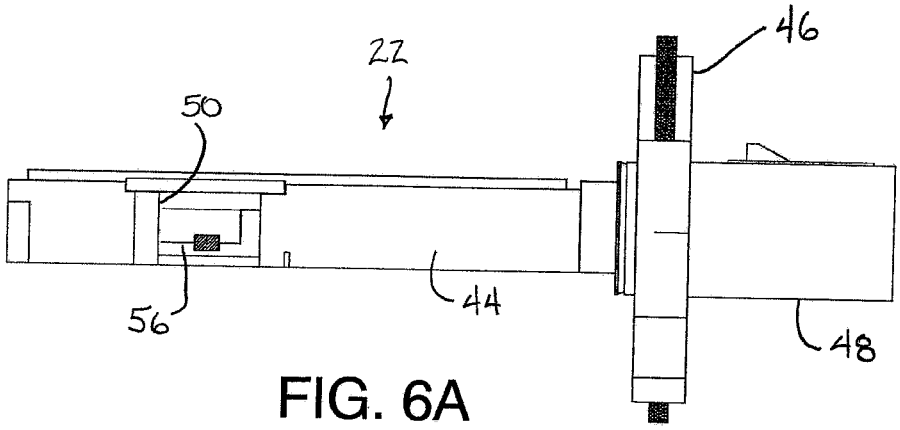
FIG. 6A is a top plan view of a mass airflow sensor removed from the mass airflow measuring device of FIG. 1.
Figure 6B:
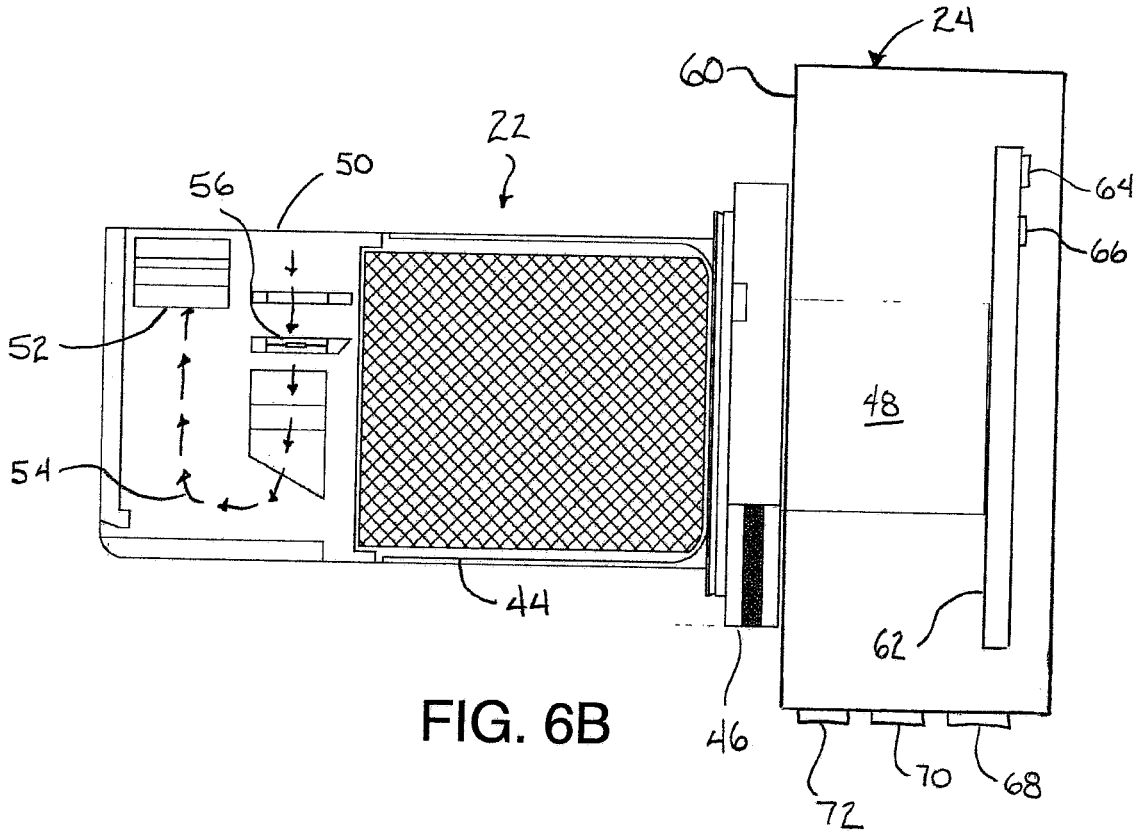
FIG. 6B is a side view of the mass airflow sensor of FIG. 6A with a processing unit affixed thereto.
Figure 6C:
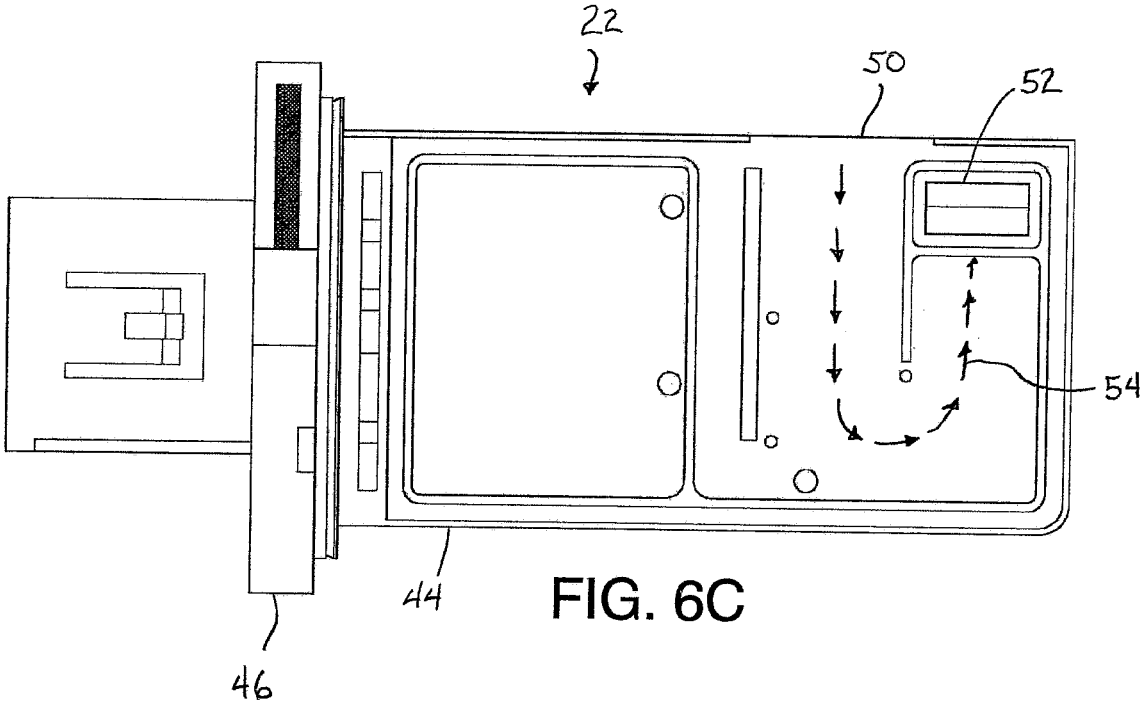
FIG. 6C is a side view of the mass airflow sensor of FIG. 6A disclosing the opposite side from FIG. 6B.
Figure 7:
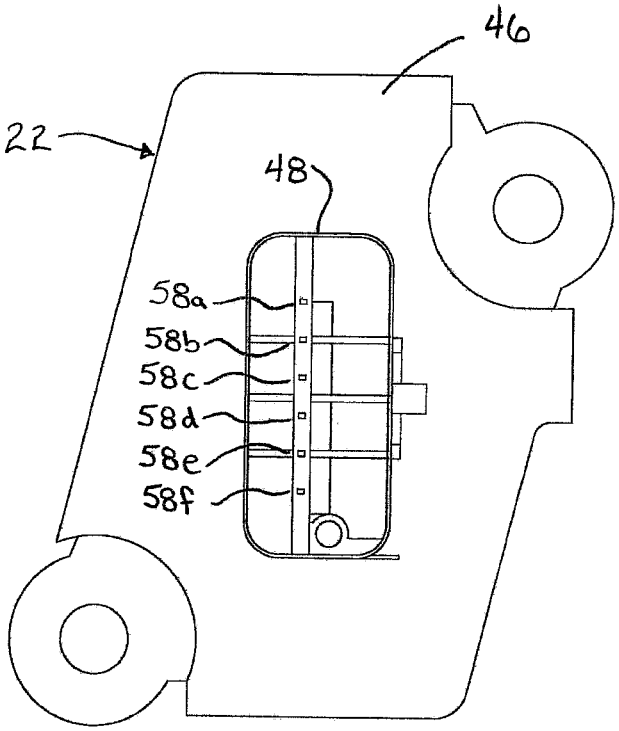
FIG. 7 is an end view of the mass airflow sensor of FIG. 6A.

With reference to FIGS. 6A-7, the illustrated mass airflow sensor 22 includes a generally rectangular, elongate, projecting housing 44, a mounting flange 46, and an electrical connector 48. Housing 44 includes an inlet aperture 50 (FIGS. 6A and 6B) through which air flowing within channel 40 enters housing 44, and includes exit apertures 52 on either side of housing 44 (FIGS. 6B and 6C) out of which air that flows within housing 44 may exit. As understood from FIGS. 2, 4 and 5, device 20 includes a receptacle 41 formed in the member or structure 43 on body 26 that defines channel 40. Receptacle 41 receives housing 44 of sensor 22 such that when sensor 22 is inserted therein inlet aperture 50 is aligned with sample channel 40 whereby air flowing within channel 40 is delivered to or directed at aperture 50.

Within housing 44, sensor 22 includes a flow passage or passageway 54, which is illustrated by arrows in FIGS. 6B and 6C, extending between inlet aperture 50 and exit apertures 52. Also included within housing 44 is a wire element 56, where air flowing within passageway 54 passes over wire 56. Wire 56 comprises the "hot wire anemometer" of sensor 22, where wire 56 is heated in conventional manner and the air flowing over wire 56 cools the wire. Sensor 22 also includes a temperature sensing device, such as a thermistor (not shown) for measuring air temperature. Sensor 22 further includes an electronic circuit that generates an airflow signal, such as a voltage signal, based on the detected changes by wire 56. In addition to providing an output signal based on airflow, sensor 22 also provides an output signal based on temperature, where the temperature signal also comprises a voltage signal. Due to the potentially highly turbulent airflow associated with HVAC systems, the sampling of air through channel 40 and subsequent further sampling of air within passageway 54 promotes a quieter airflow voltage signal output from sensor 22—that is, a signal with less noise or fluctuation.

Electrical connector 48 includes various pins or contacts 58*a*-58*f* (FIG. 8) providing the flow and temperature signals, as well as providing ground and power to sensor 22. Processing unit 24 includes a housing 60 and a circuit board 62, where housing 60 is mounted to connector 48 such that circuit board 62 makes operative connection with pins 58*a*-58*f*. Processing unit 24 further includes output connections 64 for providing the processed signal, as discussed below, to the DDC, and a voltage supply connection 66 for providing power to processing unit 24 and sensor 22. Processing unit 24 may further include a diagnostic port 68, such as an RS-232 connection, a programming port 70, and/or a manual adjust knob 72, such as a potentiometer.

The operation of device 20 with processing unit 24 will now be discussed with reference to FIG. 8. Sensor 22 outputs both an airflow signal 74 and a temperature signal 76 to processing unit 24, where in the illustrated embodiment the airflow signal 74 is a voltage signal corresponding to the airflow detected by sensor 22 and the temperature signal 76 is a voltage signal corresponding to the temperature detected by sensor 22. Signals 74 and 76 may comprise voltage signals ranging from 0-5 volts, with the signals being non-linear relative to the actual airflow rate and with processing unit 24 converting the signals from analog to digital.

Regarding airflow, processing unit 24 receives signals 74 and initially buffers received signals to determine a time averaged signal value, where the average is calculated by processing unit 24 as illustrated at 78 to provide an averaged signal 80 that is determined over an adjustable time duration. Airflow within HVAC systems can include a significant amount of turbulence, thus resulting in a fluctuating airflow signal 74 being output from sensor 22. By determining an averaged flow signal 80, device 20 is able to provide a useable value to the DDC of the HVAC system that is both accurate and generally non-fluctuating. The time duration over which averaging occurs at 78 may be adjusted from, for example, 0 to 10 seconds, with the time being set via programming port 70 and/or knob 72.

Upon determining an averaged flow signal 80, processing unit 24 further converts the signal 80 to correspond to a linear value. For example, sensor 22 outputs a voltage value corresponding to airflow where the voltage is output in a non-linear manner relative to the actual airflow, such as a logarithmic voltage with respect to airflow. Accordingly, processing unit 24 converts the non-linear signal 80 to a linear signal prior to providing the signal to the DDC of the HVAC system, with this operation being illustrated at 82 within processing unit 24. In one embodiment, the operational step 82 is accomplished by way of a look up table, where the table provides a pre-defined linear output value corresponding to a given non-linear averaged flow signal 80. In such an embodiment the look up table may be generated by calibrating device 20 or sensor 22 over a given range of known flow rates. For example, sensor 22 may initially be subjected to a number of known airflow rates, with the airflow signal 74 from sensor 22 being recorded for each of the known airflow rates. This will result in a table or data set of voltages versus flow rates where the voltages are nonlinear relative the flow rates. A linearized voltage output versus flow rate correlation is then created, such as in the form of a lookup table, where linear interpolation may be used to assign voltage output signals for input signals received from sensor 22 that are not contained in the calibrated data set. Processing unit 24 is thus configured to output an alternative voltage corresponding to a given detected airflow with the output voltage being linearly related to the flow rate. That is, upon receiving a voltage signal from sensor 22, such as signal 74, processing unit 24 will look up a corresponding programmed voltage signal to output that corresponds to the input voltage signal to provide a linearized voltage output signal representative of the actual airflow. Such an operation may be applied at 82 in FIG. 8. In another embodiment, the operational step 82 may be performed mathematically based on processing unit 24 conditioning the signal such as by floating point mathematics, such as in a microcontroller of processing unit 24.

Upon determining the linear value associated with signal 80, processing unit 24 then converts the value from digital to analog to output a linear flow signal 84, which may comprise a voltage signal ranging between 0-5 volts, or be amplified from 0-10 volts, or otherwise as required, corresponding to the airflow through device 20. The linearized flow signal 84 is then provided to the HVAC system controller, such as DDC 86 shown in FIG. 8. An exemplary DDC may be an APOGEE provided by Siemens Building Technologies, Inc.

Figure 8:
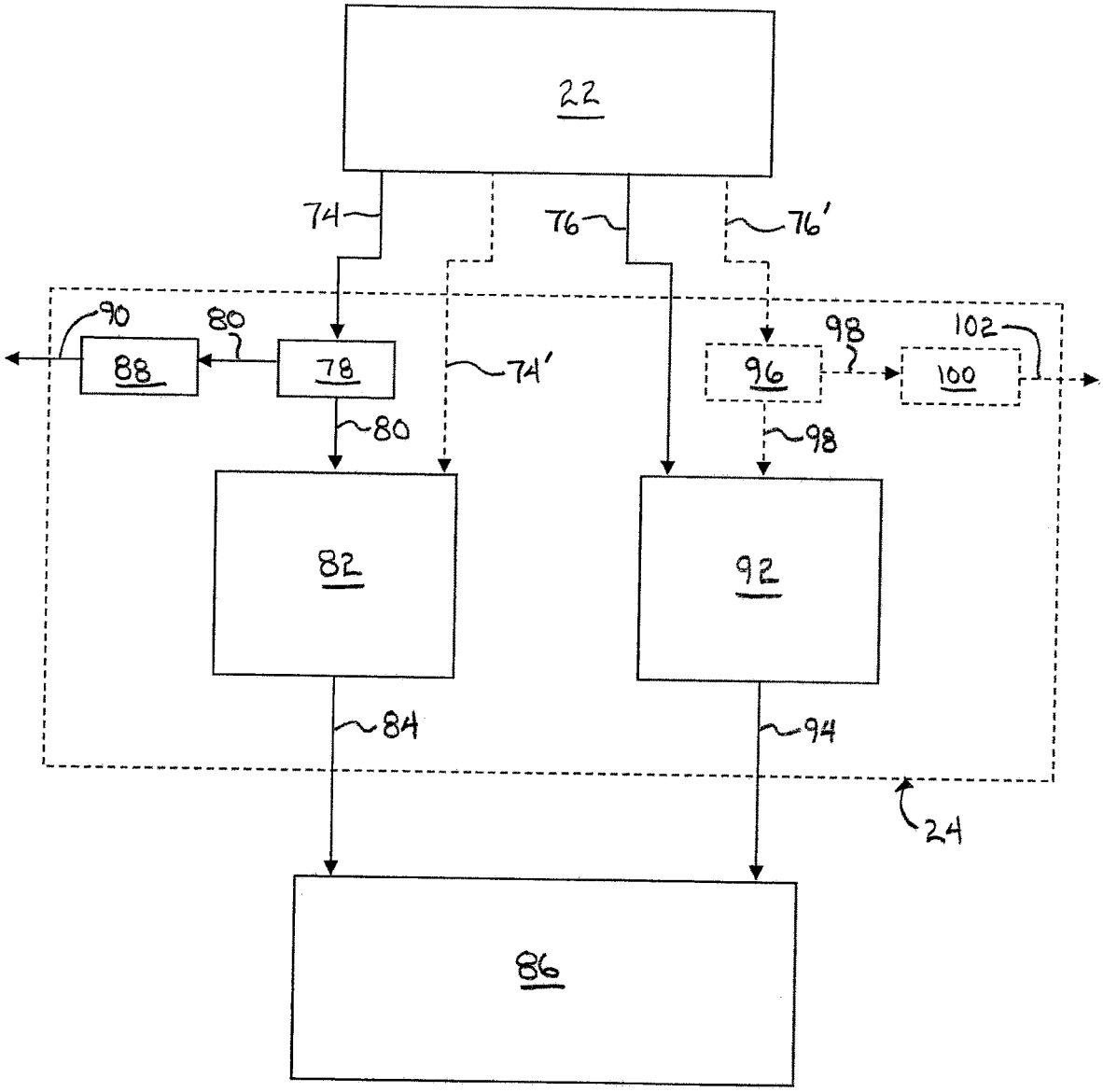
FIG. 8 is an operational flow diagram of the mass airflow sensor and processing unit of the mass airflow measuring device of FIG. 1.

As further shown in FIG. 8, the averaged flow signal 80 may be further processed to calculate a rolling average of flow signal 80 values, with such operation being illustrated at 88 to create a rolling average flow signal 90. Signal 90 may be provided to enable a visual reading of the flow values. Alternatively, signal 80 may be directly provided to enable a visual reading of flow values. That is, the value may be displayed on a screen or display for reading by a technician.

Figure 9:
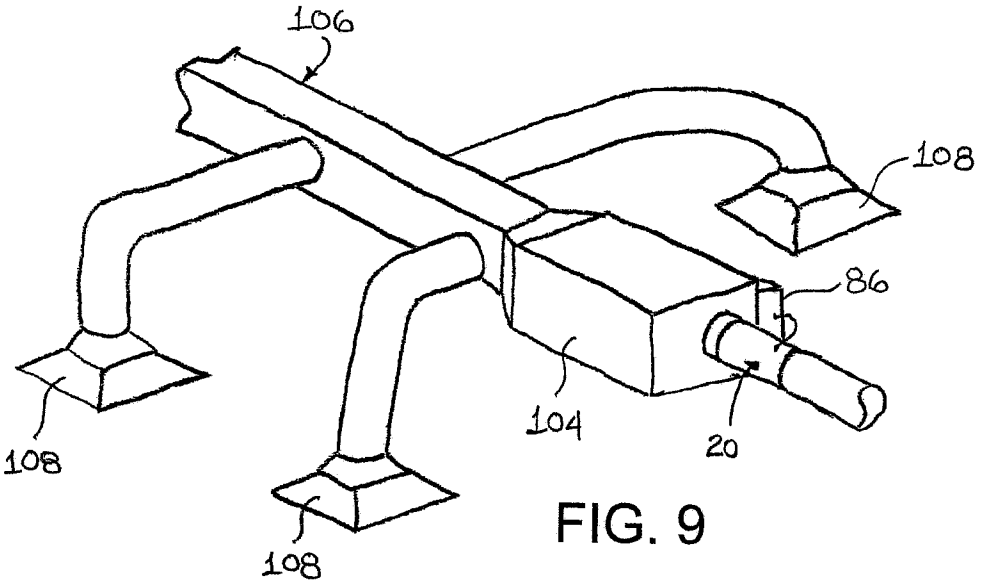
FIG. 9 is a perspective view of an HVAC system with a variable air volume (VAV) box to which is connected a mass airflow measuring device in accordance with an embodiment of the present disclosure.

Temperature signal 76 is provided to processing unit 24, with the signal 76 being processed as illustrated at 92 in FIG. 9 to derive a linear value corresponding to the received non-linear voltage signal 76. This operation may be performed mathematically based on processing unit 24 conditioning the signal such as by floating point mathematics in a microcontroller of processing unit 24. Processing unit 24 additionally converts the linear value from digital to analog to output a linear temperature signal 94, which may comprise a voltage signal ranging between 0-5 volts, or be amplified from 0-10 volts, or otherwise as required. The linearized temperature signal 94 is then provided to the HVAC system controller, such as DDC 86 shown in FIG. 8.

As an alternative, an airflow signal may be directly processed by processing unit 24 without an averaging calculation, such as illustrated at 74' in FIG. 8. Still further, a temperature signal may alternatively be buffered or averaged in like manner to the operation discussed above with regard to airflow signal 74, where such operation is illustrated at 96 in FIG. 9 in connection with temperature signal 76'. An averaged temperature signal 98 may then be further processed within processing unit 24, such as at 92 and/or to determine a rolling average as illustrated at 20 to derive a rolling average temperature signal 102.

Utilizing the accurate airflow signal 84 and temperature signal 94 supplied to the HVAC system provides operational real time precision measurement of air volume, thus enabling controlled temperature adjusted airflow to various zones within a building while maintaining required ventilation and providing significant energy savings.

As shown in FIG. 9, device 20 may be implemented in connection with a variable air volume (VAV) terminal unit or box 104 of an HVAC system, where the VAV box 104 is electronically connected to a DDC 86 for operational control, as well as to a ductwork system 106 to provide controlled airflow out of air terminals 108 to various zones of a building. In such an application device 20 is integrally joined with VAV box 104, and may have an outside diameter of, for example, between four inches to sixteen inches depending on the particular parameters of the VAV box with which device 20 is integrated.

Figure 10:
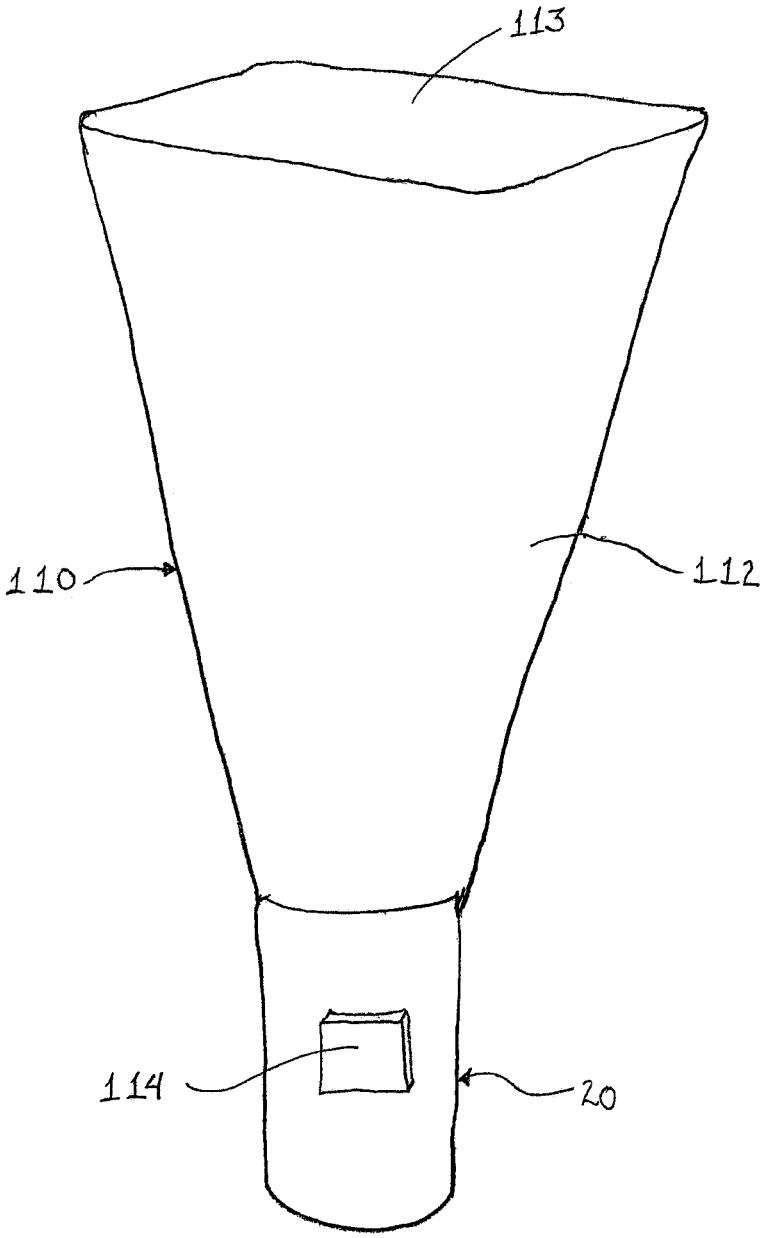
FIG. 10 discloses an air balancing hood to which is connected a mass airflow measuring device in accordance with another embodiment of the present disclosure.

Alternatively, as shown in FIG. 10, device 20 may be used in connection with or integrated as an air balancing hood 110, such as for measuring the airflow out of an air terminal within a building. Such an air balancing hood 110 includes an apparatus 112 with an opening 113 for positioning over the air terminal to direct the airflow into the hood, where the apparatus 112 comprises a cloth like channeling member to direct the airflow to device 20. In such an embodiment, device 20 may be provided with a display 114 for displaying airflow readings to an operator. Still further, yet another alternative mass airflow measuring device may be constructed to have a rectangular outer profile and operatively used with outside air ventilation ductwork.

Figure 11:
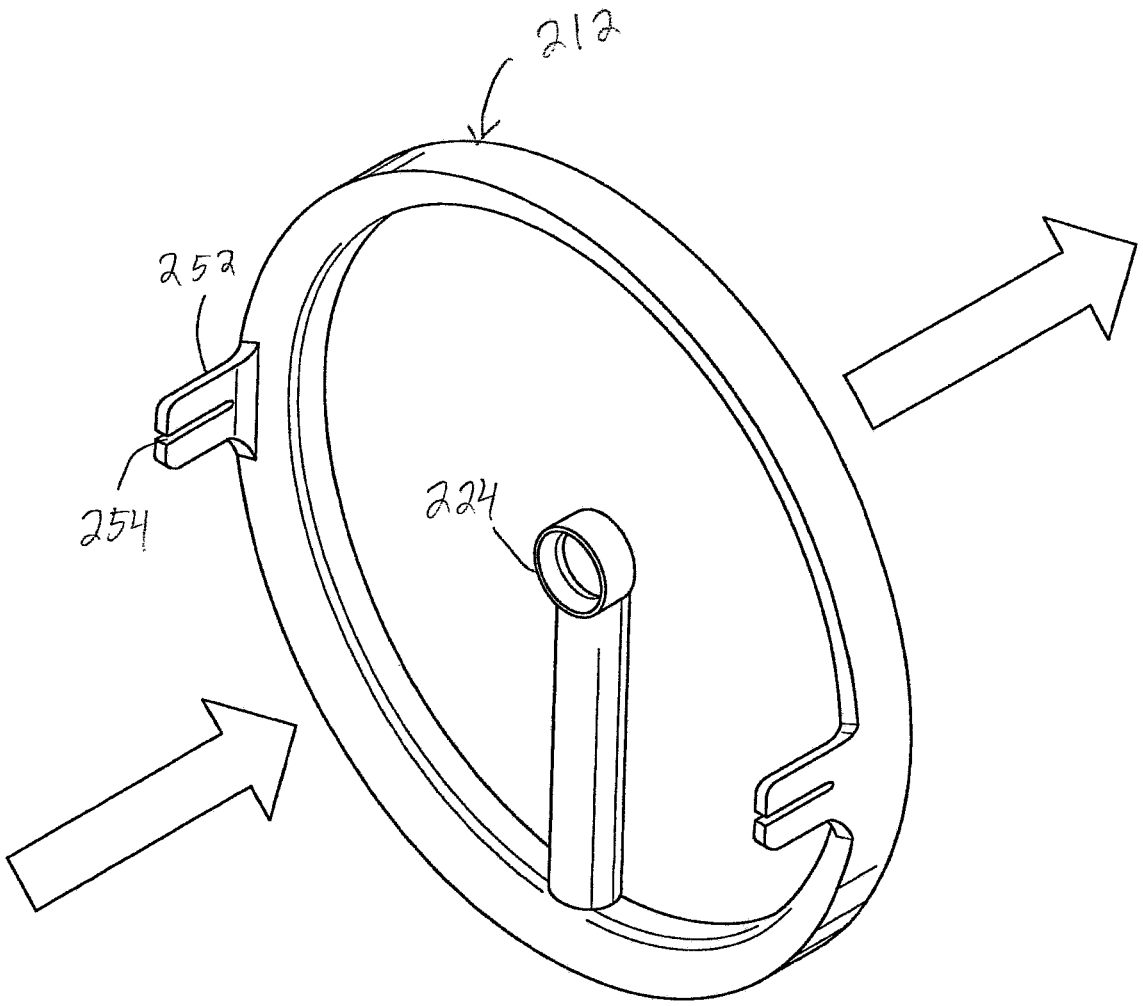
FIG. 11 is a perspective view of a front portion of a mass airflow measuring device according to still another embodiment of the present disclosure.
Figure 12:
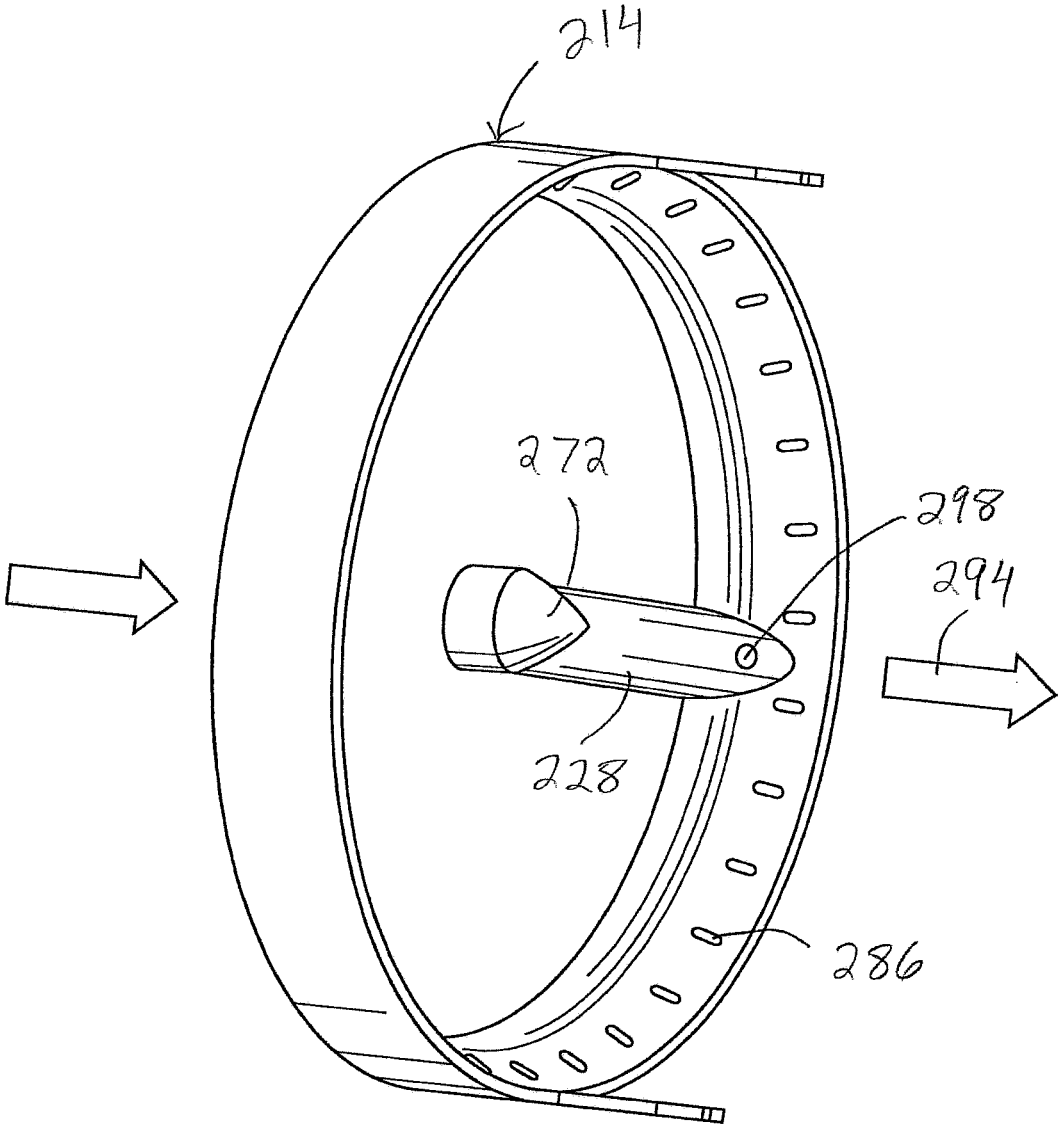
FIG. 12 is a perspective view of a rear portion of the mass airflow measuring device of FIG. 11.
Figure 13:
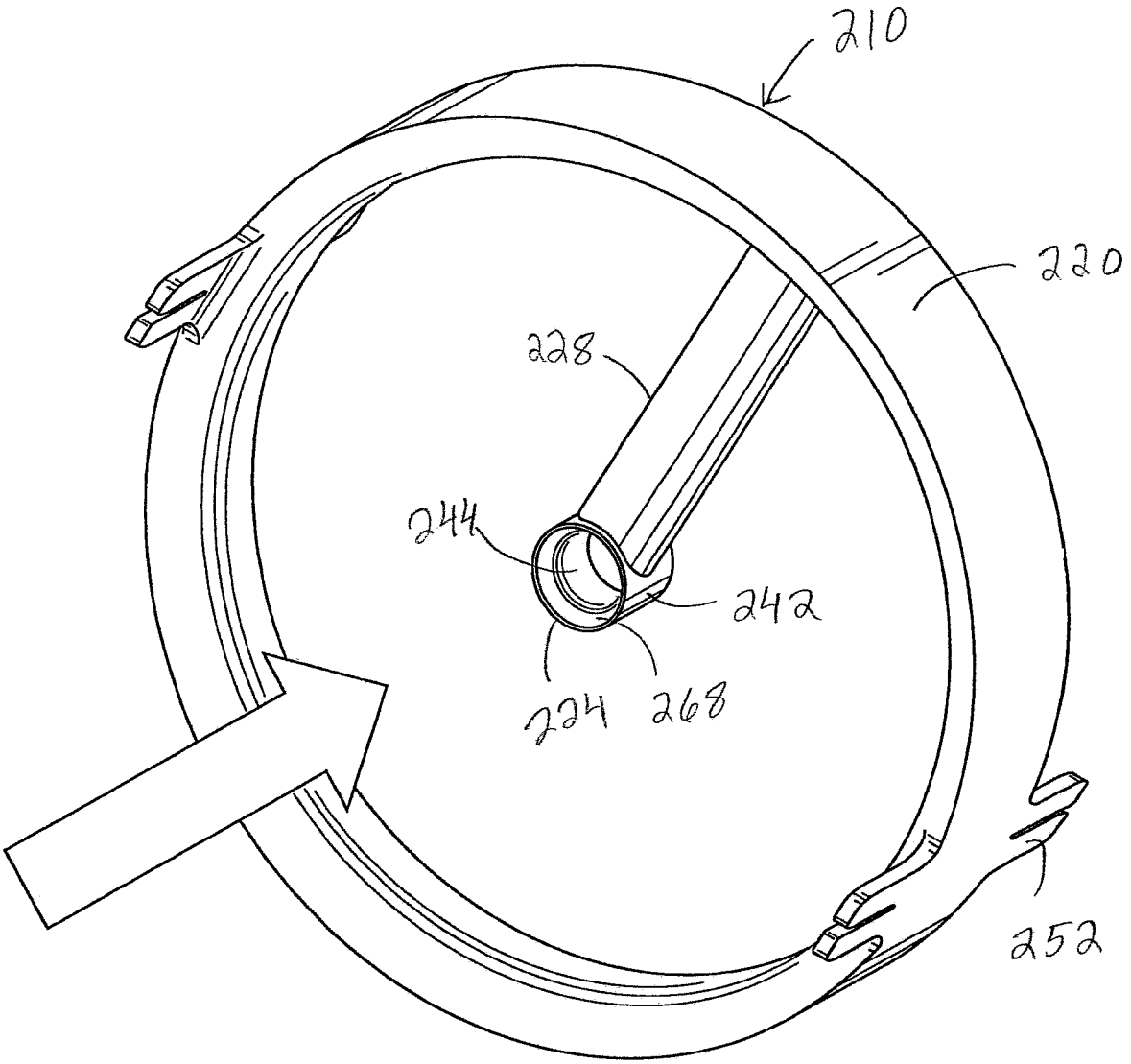
FIG. 13 is a perspective view of the airflow measuring device of FIGS. 11 and 12 in an assembled condition.

FIG. 13 illustrates a mass airflow measuring device 210 according to another embodiment of the present disclosure. With reference now also to FIGS. 11 and 12, in this embodiment, the mass airflow device 210 includes a front half 214 and a rear half 216. These are joined together in a conventional fashion so as to form the entire mass airflow device. In one embodiment, the device can be made of a suitable thermoplastic material, such as an ABS plastic or, perhaps, polystyrene. Alternatively, the device could be made from a conventional metal, such as an aluminum alloy.

One benefit of providing a two-part design, namely, the front half 214 and the rear half 216 is that the device can be either molded or die cast and press fit together. This then eliminates the need to weld or machine features onto the device. In one embodiment, the two parts are made of a suitable plastic material. The two parts can be aligned/fit in relation to each other with a simple solvent applied to the plastic parts (such as an ABS plastic) and then pressed together. The solvent will create an airtight bond similar to a PVC pipe joint.

With reference again to FIG. 13, the device 210 comprises a peripheral section 220, a sample section 224 which is located radially inward of the peripheral section, and a support section 228 which joins the sample section to the peripheral section.

Figure 14:
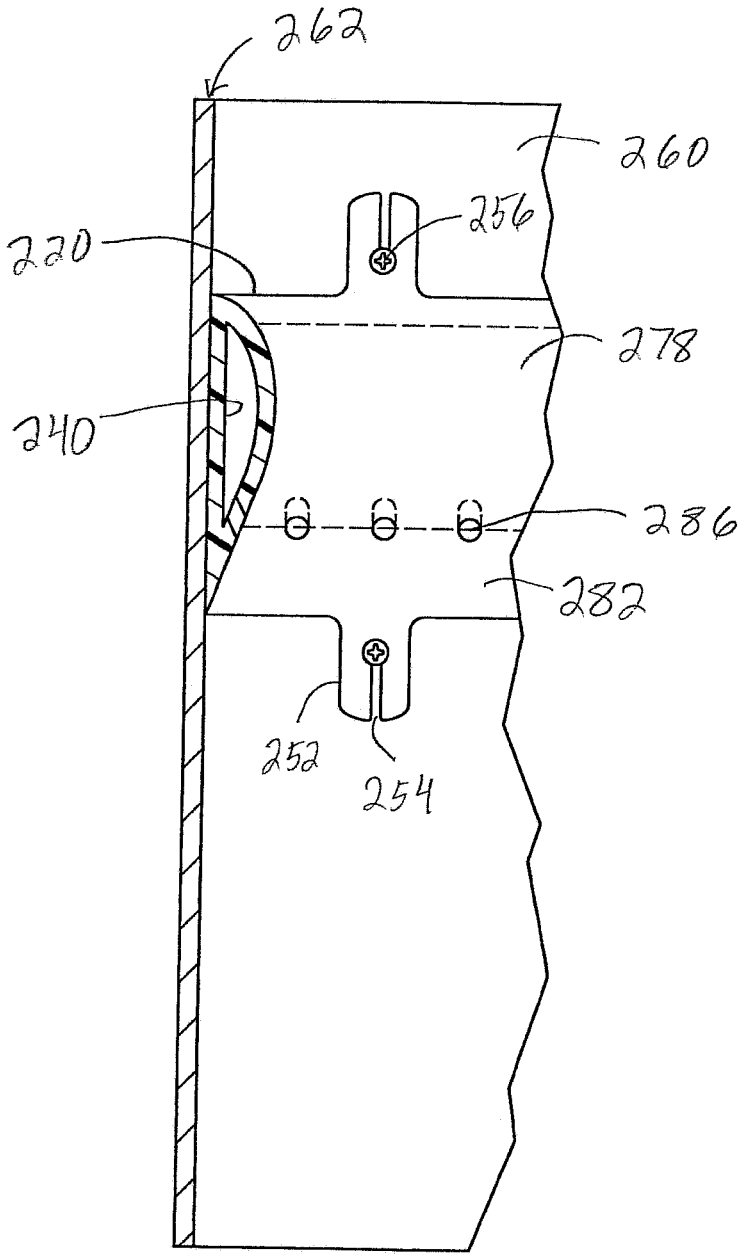
FIG. 14 is a broken-away cross-sectional view of a portion of the mass airflow measuring device of FIG. 13 mounted in an air conduit.

As illustrated in FIG. 14, the peripheral section 220 includes a first channel 240 which extends toroidally within the peripheral section. It is noted that the peripheral section itself is toroidal or ring-shaped. It has a flat rear wall surface and an airfoil-shaped front wall surface.

Figure 15:
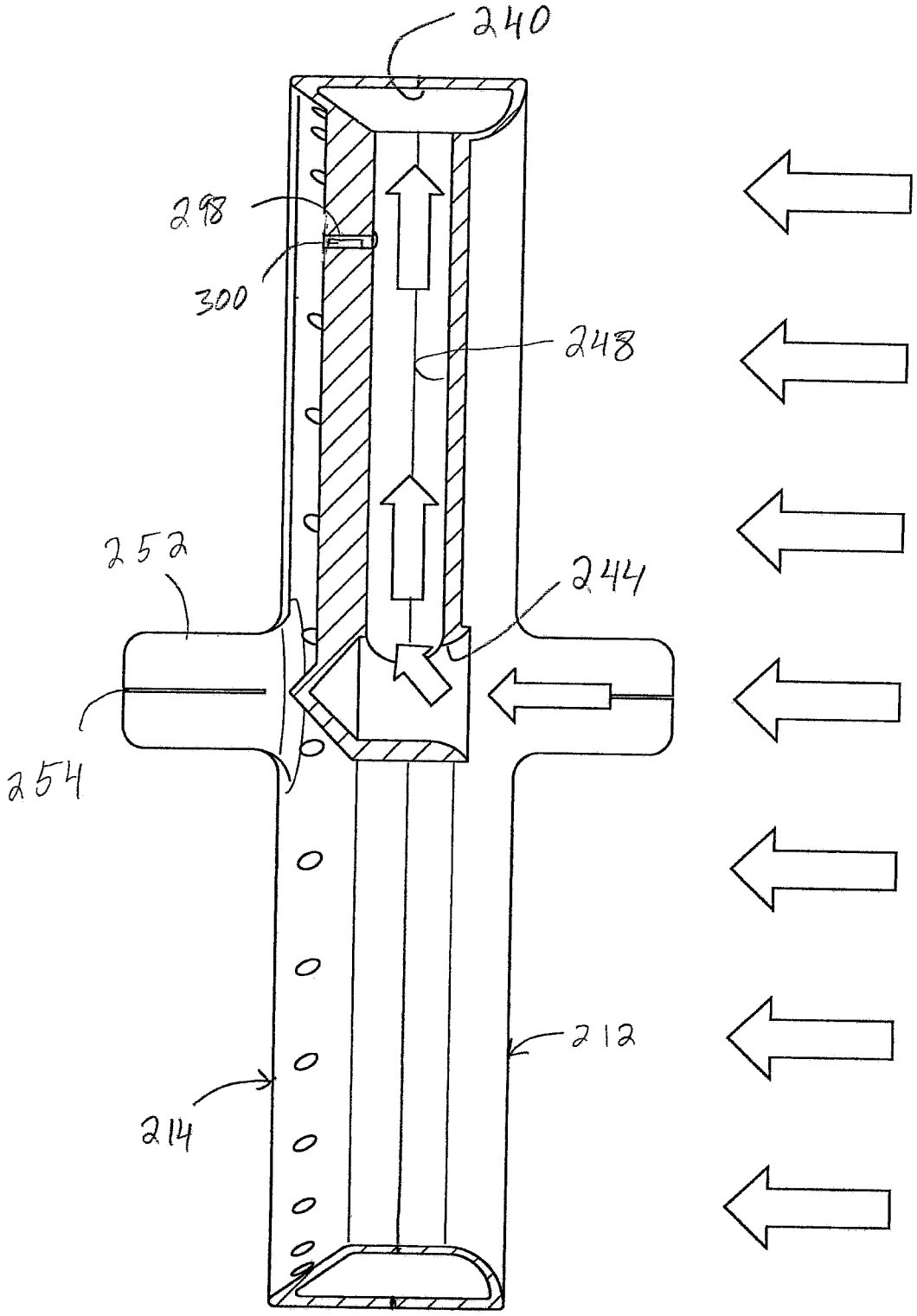
FIG. 15 is an enlarged side elevational view in cross section of the device of FIG. 13 on an enlarged scale.
Figure 16:
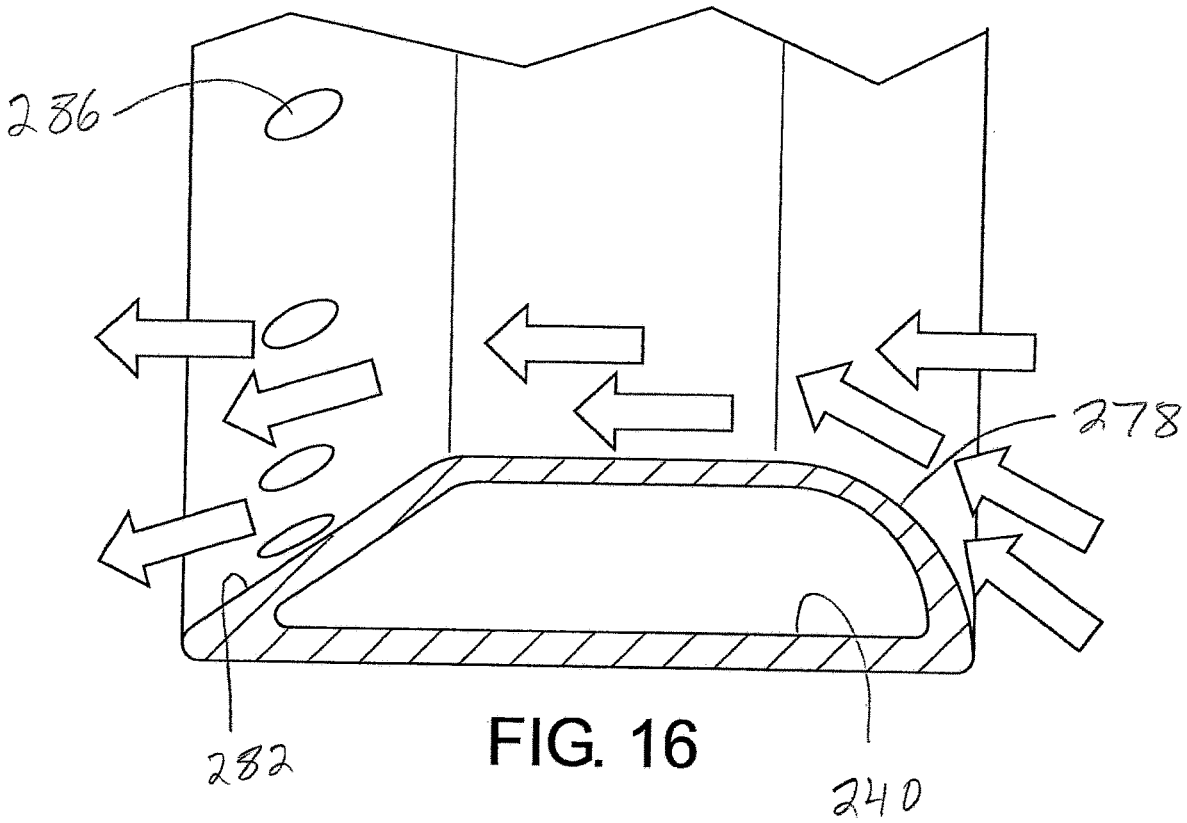
FIG. 16 is a greatly enlarged view of a portion of the device of FIG. 15 illustrating airflow over a peripheral portion of the device.

With reference again to FIG. 13, the sample section 224 comprises a cylindrical body 242 defining an inlet port 244. The inlet port 244 communicates with a second channel 248, as best seen in FIG. 15. More particularly, a first end of the second channel 248 communicates with the inlet port 244 and a second end of the second channel communicates with the first channel 240.

At least one of the front and rear halves 214 and 216 of the device 210 include at least one protrusion 252. With reference now to FIG. 14, the protrusion 252 can include an aperture 254 which can accommodate a fastener 256. FIG. 14 illustrates the device 210 as being secured to an interior wall 260 of a duct 262. The protrusions or tabs can be integrally manufactured, such as by casting or molding of the components of the mass airflow device 210.

In the embodiment illustrated in FIG. 13, it can be seen that four tabs or protrusions 252 are provided for the mass airflow device 210, all located on an exterior surface of the peripheral section 220. It should be appreciated, however, that any desired number of such protrusions or tabs can be provided as may be needed in order to secure the mass airflow device 210 to the interior periphery of a duct.

Although a four fastener mounting is illustrated in FIG. 13, it should be appreciated that two fasteners or perhaps even one and corresponding tabs could be sufficient to hold the device 210 in place. The benefit of additional fasteners, such as screws is to ensure that the device is and remains oriented perpendicular to airflow through the duct.

With reference again to FIG. 13, the sample section 224 includes an airfoil-shaped front end 268 such that the diameter of the inlet port 244 is smaller than is a diameter of the cylindrical body 242. The peripheral section also includes a cone-shaped rear end 272 as is best seen in FIG. 12.

A plurality of apertures or outlet ports 286 located on the trailing face communicate with the first channel 240. As mentioned, the peripheral section front wall has an airfoil-shape in order to minimize restrictions and pressure drop and also to create a pressure differential between the inlet port 244 of the sample section 224 and the outlet ports defined in the peripheral section 220. To this end, the peripheral section front wall includes a rounded leading face 278 and a tapering trailing face 282 as is illustrated in FIG. 14. It is noted that the back wall or outer surface of the peripheral section is planar so as to closely adjoin or lie flat against the interior wall 260 of the duct 262.

The sample section or intake section 224 is centrally located in this embodiment of the mass airflow device. Also, the sample section 224 tapers and contours in order to minimize turbulence and enhance a smooth flow of air as illustrated by arrow 294 in FIG. 12. The location of the sample section and its inlet port 244 relative to the exhaust ports or apertures 286 creates a maximum pressure differential utilizing the airfoil shape of the peripheral section and enhances a low flow measurement capability. Also, sampling from the center of the device 210, i.e., center of a flow diameter of the duct, provides superior turn down, i.e., low flow calibration, in low flow environments.

As best seen in FIG. 12, an opening 298 can be provided in the support section 228 in order to accommodate a known mass airflow sensor. As is known in the art, the mass airflow sensor can sample air flowing through the second channel 248. A stylized representation of such a sensor is provided in FIG. 15 and identified by the numeral 300. Such a sensor can be a thin film resistor, a hot wire sensor or the like. This design facilitates the presence of a proportional airflow passing across a mass airflow sensor. That, in turn, enables the accurate calculation of actual flow through the device 210.

The tapered edge of the airfoil design of the peripheral section 220 enhances the pressure differential between the inlet port 244 and the outlet ports or apertures 286. This enhances the ability of the mass airflow device to measure flow rates as low as ten feet per minute. It is believed that the flow measurement capability of the device 210 is at levels unheard of in the HVAC industry.

In this embodiment, due to the fact that the device 210 is toroidal in its peripheral section, the device is adapted for use in a cylindrical air duct. It should be appreciated, however, that other geometric shapes for the air ducts, such as ovals, will dictate an oval shape for the peripheral section. Such shapes for the peripheral section are also contemplated in order to accommodate ducts of different shapes.

The aerodynamic features of the sampling tube include the round tube section 242, the bullet or cone shaped rear end 272 of the sample section 224 and the fact that the inlet port 244 is located in the center of the diameter of the mass airflow measuring device 210.

A laminar flow exists through the duct past the device 210 because the device maintains a target ratio of length over diameter (L/D) of 10 for the measurement system.

The sample section 224 incorporates aerodynamic features in the cylindrical body 242 in order to enhance an extremely low pressure drop when compared to previous designs employing flow tubes and flow crosses. The device incorporates such aerodynamic features in the sample section 224 so that non-sampled air will flow around the bullet nose and return to the air stream with minimal pressure drop. The device also creates minimal flow turbulence.

In one embodiment, for an 8 inch diameter device, 32 exhaust ports 286 of equal diameter can be provided for a six inch mass airflow sensor diameter. It should be noted that the exhaust port diameters, port to port, are identical in one embodiment. The exhaust port diameter is determined based on the sensor diameter design for the device 210. Thus, the exhaust port diameter may or may not change proportionally with each new sensor diameter. The exhaust ports can be given a shape other than the oval shape illustrated. For example, they can be rectangles, slits or other openings which facilitate a consistent pressure drop to move air from the inlet port 244 to the exhaust ports 286, such that the air passes across the mass air sensor 300. In one embodiment, the center tube opening radius can be 8 mm.

The cross sectional airfoil profile and the number of exhaust ports will increase or decrease proportionally, as the duct diameter changes. For example, sensors for ducts as small as 5 inches in diameter and as large as 24 inches in diameter can be provided. It is contemplated that device diameters of 6, 8 and 10 inches are the most likely to be used. Also, the airfoil sizing may change depending upon application needs.

It is believed that the profile type illustrated provides improved accuracy at low flow rates. The accuracy is believed to be superior to current designs and even superior to current market needs. However, market requirements are ever changing. The current profile is meant to achieve a balance between pressure drop (very little restriction at low flow velocities) and low flow sensitivity. More aggressive profiles will increase the restriction/pressure differential and, thus, could increase flow rate measurement accuracy.

The device 210 can be manufactured from a variety of materials, including known metals, plastics or resins. It can be manufactured by a variety of methods, including machining, die casting and molding. The device can be scaled to a variety of sizes to fit standard or custom, round or oval airflow configurations.

While the device has been employed in the embodiments illustrated herein to measure airflow in an air duct of a building's HVAC system, it should be appreciated that the device can measure the flow of a variety of fluids, such as gaseous fluids in a variety of environments. These can include steam and natural gas flows in industrial installations, and the like.

Changes and modifications in the specifically described embodiments can be carried out without departing from the principles of the present disclosure. The disclosure is intended to be limited only by the scope of the appended claims, as interpreted according to the principles of patent law including the doctrine of equivalents.

The invention claimed is:

1. A mass airflow measuring device, comprising:

an air passageway;

a body positioned in the passageway, the body comprising:

a peripheral section including a first channel, wherein the peripheral section is toroidal in shape and wherein the peripheral section includes a planar outer face adapted to contact a wall of the air passageway and an airfoil-shaped inner face including a rounded leading surface and a tapering trailing surface, a sample section located radially inward of the peripheral section and including an inlet port, and a support section connecting the sample section to the peripheral section, the support section including a second channel which communicates at a first end with the inlet port and at a second end with the first channel; and a mass airflow sensor mounted to the body.

2. The device of claim 1 wherein the peripheral section contacts an inner periphery of the air passageway.

3. The device of claim 1 further comprising at least one outlet port disposed on said peripheral section, the at least one outlet port communicating with the first channel.

4. The device of claim 1 wherein a plurality of spaced outlet ports are disposed on the trailing surface of the peripheral section.

5. The device of claim 1 further comprising a protrusion extending from the body, the protrusion defining an opening adapted to accommodate a fastener for securing the body to a wall defining the air passageway.

6. The device of claim 1 further comprising a processor which receives an airflow signal from the airflow sensor.

7. The device of claim 6 wherein the processor communicates with a controller of an HVAC system.

8. A mass airflow measuring device, comprising:

an air passageway defined in a duct;

a body positioned in the passageway, the body comprising a leading side and a trailing side which are secured to each other, the body comprising:

a ring-shaped peripheral section adapted to be mounted to the duct, the peripheral section including a first channel, wherein the peripheral section includes a planar outer face adapted to contact a wall of the duct and an airfoil-shaped inner face including a rounded leading surface and a tapering trailing surface, a sample section located radially inwardly of the peripheral section and including an inlet port, and a support section connecting the sample section to the peripheral section, the support section including a second channel which communicates at a first end with the inlet port and at a second end with the first channel; and a mass airflow sensor mounted to one of the support section and the peripheral section and communicating with the second channel.

9. The device of claim 8 further comprising at least one outlet port disposed on said peripheral section, the at least one outlet port communicating with the first channel.

10. The device of claim 8 wherein the inlet port communicates via the first and second channels with a plurality of spaced outlet ports disposed on the trailing surface of the peripheral section.

11. The device of claim 8 wherein the sample section comprises a cylindrical body including a front end comprising an airfoil-shaped inner face including a rounded leading surface communicating with the inlet port.

12. The device of claim 8 wherein the sample section comprises a cylindrical body which includes a cone-shaped rear end.

13. The device of claim 8 further comprising a protrusion extending from the peripheral section of the body, the protrusion defining an opening adapted to accommodate a fastener for securing the body to a wall of the duct.

* * * * *